US009970173B2

(12) United States Patent
Ditillo et al.

(10) Patent No.: US 9,970,173 B2
(45) Date of Patent: May 15, 2018

(54) DEVICE FOR DEEP DRIVING OF TUBES HAVING A LARGE DIAMETER

(71) Applicant: Soilmec S.p.A., Cesena (FC) (IT)

(72) Inventors: Alessandro Ditillo, Cesena (IT); Jasmin Curic, Cesena (IT); Ezio Biserna, Cesena (IT); Marco Casadei, Cesena (IT); Alessandro Giunchedi, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 0 days. days.

(21) Appl. No.: 14/643,098

(22) Filed: Mar. 10, 2015

(65) Prior Publication Data

US 2015/0259871 A1 Sep. 17, 2015

(30) Foreign Application Priority Data

Mar. 13, 2014 (IT) ..... MI2014A0407

(51) Int. Cl.

| | |
|---|---|
| ***E02D 7/00*** | (2006.01) |
| ***E02D 5/38*** | (2006.01) |
| ***E02D 5/28*** | (2006.01) |
| ***E02D 5/66*** | (2006.01) |
| ***E02D 7/26*** | (2006.01) |
| ***E02D 7/28*** | (2006.01) |
| ***E02D 11/00*** | (2006.01) |
| ***E02D 15/04*** | (2006.01) |

(52) U.S. Cl.

CPC ..... *E02D 5/385* (2013.01); *E02D 5/285* (2013.01); *E02D 5/66* (2013.01); *E02D 7/26* (2013.01); *E02D 7/28* (2013.01); *E02D 11/00* (2013.01); *E02D 15/04* (2013.01)

(58) Field of Classification Search

USPC ..... 405/227, 228, 231, 232; 166/85.5

See application file for complete search history.

(56) References Cited

U.S. PATENT DOCUMENTS

| | | | | |
|---|---|---|---|---|
| 5,944,452 | A * | 8/1999 | Reinert, Sr. | E02D 7/20 173/184 |
| 6,471,445 | B2 * | 10/2002 | Stansfield | E02D 7/20 175/391 |
| 2013/0294843 | A1 * | 11/2013 | Biserna | E02D 7/30 405/249 |

FOREIGN PATENT DOCUMENTS

EP 0874088 A2 10/1998

OTHER PUBLICATIONS

European Search Report issued in corresponding Italian Patent Application No. MI2004A000407, filed Mar. 13, 2014.

* cited by examiner

*Primary Examiner* — Sean D Andrish
(74) *Attorney, Agent, or Firm* — Lucas & Mercanti, LLP

(57) ABSTRACT

A tubing device is operatively connectable to an excavation machine. The tubing device comprises a base frame, at least one guiding tower operatively connected to the base frame, and a tube operating unit, operatively connected to the guiding tower. The tube operating unit is slidable along the guiding tower and is provided with engaging means capable of both selectively holding a tube segment, and of transmitting a rotary motion and an axial sliding movement to such a tube segment so as to allow the progressive driving in the ground and subsequent extraction from the ground.

15 Claims, 7 Drawing Sheets

DEVICE FOR DEEP DRIVING OF TUBES HAVING A LARGE DIAMETER

CROSS-REFERENCE TO RELATED APPLICATIONS

The present application claims the priority of Italian Patent Application No. MI2014A000407, filed Mar. 13, 2014, the contents of which are incorporated herein by reference.

FIELD OF THE INVENTION

The present invention refers to a device for driving in the ground or extracting from the ground tube segments having a large diameter.

BACKGROUND OF THE INVENTION

In the field of foundations it is often required to have excavations having a large diameter, at great depth and with minimal deviations with respect to their vertical axis. An example of application in which such excavations are required consists of making impermeable partitions carried out through intersecting piles. In these cases the guarantee of actual interpenetration of the primary and secondary piles, closely linked to the verticality of the excavations, is an essential condition to carry out the work correctly. The uncertainty of the verticality of the pile leads to onerous corrective choices, the most obvious of which is to reduce the pitch between the axes of the intersecting piles so as to compensate, with greater interpenetration, the possible deviations that can be created between adjacent piles. Of course, this translates into over-consumption of cement mixture and into longer work times in making a partition of known length.

The use of a guide tube to drive to the bottom of the excavation, which can act as a guide for the excavation tool, ensures better verticality of the pile. This is due to the much more rigid configuration of the tube with respect to that of a battery of telescopic rods or of a continuous helix, and the greatest advantages are obtained in the case in which layers of earth of very variable conformity and hardness are crossed. The use of the guide tube, (generally called "casing"), due to the high friction that is generated with the walls of the excavation, requires greater torques and greater pull-push forces at the excavation machines. In particular, such friction increases as the length and diameter of the guide tube increase. This means that above certain diameter and depth values it becomes disadvantageous to make a single machine that performs both the driving of the tube, and the excavation, since such a machine would have to be too big and cost too much. The use of external apparatuses connected to the excavation machine can allow greater diameters and tubing depths, but it greatly limits the mobility and speed of the excavation machine, as well as increasing costs.

Known machinery for making tubed piles can be substantially split into two categories, as a function of the depth of the pile. In order to make piles of medium-low depth, quantifiable in the value of 30-35 meters at most, it is foreseen to use a tracked machine equipped with a vertical tower, along which two rotary tables, commonly called "rotaries", can slide, one on top of the other, in a constrained or independent manner. The two rotary tables both translate on the same sliding guides present in the tower. The upper rotary table sets a helix in translation and in rotation, said helix being equipped in its lower part with a tip with excavation teeth and has a length substantially equal to that of the tower. The lower rotary table sets a coating tube in translation and in rotation, usually in the opposite sense of rotation to that of the helix. The tube and the lower rotary table have a diameter such as to make the helix transit inside them, actuated by the upper rotary table. The tube is equipped with blades in its lower part and in its thickness in contact with the ground, so as to separate, while moving forward, a core of ground that will later be broken up and lifted by the helix above. The broken up ground is loaded by the auger of the helix and sent outside of the excavation.

The tube has a maximum installable length that is substantially less than that of the helix and that can be determined by subtracting the length of the rotary table that moves the tube itself from the length of the helix. The lower rotary table, commonly called "tubing device", can generally have a length of about 3 meters. As a result, when the pile is finished, the tubed part represents a fraction of the total length of the excavation, generally not more than ⅔. It is not foreseen, in this type of equipment, to join additional tube or helix elements as the excavation progresses. Consequently, the depth reachable by the helix corresponds to about the length of the tower of the machine and the depth reachable by the tube depends on the maximum loadable length below the lower rotary table.

It is difficult for the maximum depth to exceed 30 meters, because for greater depths the machine would have to have a tower that is too long, which would be too heavy for the machine and could cause instability. On the other hand, it would be necessary to make extremely heavy and bulky machines, but becoming incompatible with all urban works where the spaces available are small. Moreover, a machine with such a long guiding tower would be difficult to transport. As the length of the tube increases, the thrust required to drive it also increases, but such a thrust must be limited based on the weight of the machine, which otherwise would tend to lift at the front. A greater tubed depth implies a greater weight of the battery of tubes and thus requires a greater extraction force of the machine, but also such an extraction force must be limited based on the size of the machine and the resistance of the tracked undercarriage. The maximum usable diameter for the tube depends on the maximum torque able to be delivered by the lower rotary table and also this must be limited based on the torsional resistance of the tower. Such resistance depends on the section and on the thicknesses of the tower. Also in this case, by exceeding certain limit values, the tower would be too heavy.

The driving of a tube having a diameter equal to 1200 millimeters to a depth of 20 meters seems to represent, as things stand, the performance limit that can be obtained by a single machine with two rotary tables. The advantageous aspects of this type of machinery ("cased secant piles" or CSP) for shallow excavations consist of the fact that the machine is relatively light and thus easy to manoeuvre and transport, it does not have support structures at the excavation, such as casing oscillators, and it moves autonomously within the worksite from one point of construction of the pile to another without the help of external transportation means. Moreover, the excavation can take place dry, without the addition of stabilizing liquids to support the walls. The absence of recycling means of such liquids, associated with the absence of vibrations, makes these CSP machines particularly suitable for use in urban settings. The addition of the cement mixture takes place through a conduit inside the shaft of the helix, with the help of an external pump. The extraction of the tube is preferably concurrent to the filling of the hole, so that the pressure exerted by the mixture can prevent the collapse of the walls no longer supported by the tube. In some cases it is possible to extract the tube at the end of filling the hole.

In order to make piles of greater depth, greater than 30/35 meters, a tracked machine with a vertical tower is generally used, along which a single rotary table moves on suitable guides. The rotary table sets a battery of telescopic rods in rotary movement, at the base of which there is an excavation tool, like for example a "bucket" or a drill. This technology, called LDP (acronym for "large diameter pile") is generally used to make deep non-secant piles, where the limitations required for the deviation from verticality are less stringent. The use of telescopic rods makes it possible to reach much greater excavation depths with the tool with respect to the length of the tower on which the rotary table slides. LDP technology foresees that the final depth is obtained through repeated partial excavations, each of which involves the driving of the tool in the ground and results in an advancement equal to the length of the tool itself. Each partial excavation is obtained by applying a thrust and a rotation on the tool and, when the tool is full, the operator lifts it up from the bottom of the excavation until it is brought above the terrain surface, where it is emptied beside the machine, onto the ground or into a truck.

A drawback of LDP technology consists of the fact that, as the depth reached increases, the duration of the active excavation step, i.e. that for filling the tool, is increasingly short in proportion to the inactive steps of descent and ascent in the excavation. Another drawback is the fact that the pile is usually excavated with the addition of stabilizing materials that prevent the hole from collapsing, such as bentonite or polymers. The use of such stabilizers requires rather complex logistics and apparatus to obtain their recovery and recycling, like for example decanting and containment tanks, sieves, grit separators, etc. These apparatuses are difficult to adapt to use in tight urban spaces or in worksites that extend for many kilometers, requiring continuous movement of the equipment.

The alternative to using stabilizing substances is to use, in combination with LDP technology, a coating guide tube that can support the walls of the hole, preventing it from collapsing. The use of the tube is particularly advantageous when excavating below the water table, since it manages to keep the outflow of ground water inside the excavation to acceptable levels. In this case, excavation is carried out "dry" and there is less need for logistics linked to stabilizing fluids. If the section of hole to be tubed has a limited depth, and in any case compatible with the power of the machine, it is possible to use the rotary table itself, mounting a hauling extension (cup) beneath it, which couples with the tube, to rotate and thrust the tube in the ground. Due to the axial bulk of the telescopic rods, which cannot extend above the head of the guiding tower, the free space for the positioning of the tube beneath the hauling extension is limited to a few meters, in general not more than six or seven. As a result, being forced to use short tubes, even for limited tubed depths it is necessary to drive in one piece of tube at a time, joining it to those already driven in. Therefore a lot of time is spent fixing together the pieces of casing tube, with spanners and bolts that are usually locked by hand.

When the depth and/or the diameter to be made become high, the torque delivered by the rotary table of the machine is insufficient and external apparatuses become necessary, distinct from the machine, to drive the tube segments by rotation and thrusting up to the desired depth and to extract them at the end of the excavation. These apparatuses are usually bulky, heavy and expensive. The external apparatuses most commonly used are casing oscillators or "rotators" (full-rotators). These apparatuses are mainly made up of a monolithic base frame and a second upper frame that is moveable with respect to the first. Both of the frames develop about a central circular passage of large diameter, completely surrounding it. Such a central passage makes it possible to introduce a tube segment from above, crossing the frames, in order to drive it into the ground. Such apparatuses must therefore be positioned at the front of a common pile driving machine, at a lower height with respect to the base of the tower of the machine and aligning their central passage on the drilling axis of such a machine. Such apparatuses are equipped with suitable actuation means that connect the moveable upper frame to the base frame, allowing the upper frame to be made to perform vertical translations and rotations about the vertical axis of the central passage. Once the upper frame, through temporary gripping means, is able to transfer these movements to the tube to be driven. During its limited axial movement, the upper frame is not guided by any structural element of the apparatus, but only by the actuators and by the tube itself. In the casing oscillators the base frame rests directly on the ground. The upper frame is equipped with hydraulic clamps or jaws to grip or release the tube. All of the actuators of the clamp are usually fed by the hydraulic system of the pile driving machine. The thrusting takes place through hydraulic cylinders that bring the upper frame towards the base frame, whereas the rotation takes place, with partial and alternate movements, through a pair of hydraulic rotation cylinders mounted opposite one another. For every partial rotation it is necessary for the jaws to grip the tube, for the rotation cylinders to carry out their limited stroke, for the jaws to release the tube and for the rotation cylinders to carry out a reverse stroke to go back into the start of rotation condition. Therefore, very long cycle times are needed to carry out the excavation.

A "rotator" in brief consists of a rotary table with a passage having a large diameter, which constitutes an upper frame and which is moveable with respect to a monolithic base frame that also extends around the passage of the table to allow the insertion of the tube. The base frame rests on the ground. The rotary table comprises a through sleeve on which geared motors are fitted that allow the rotation thereof. Such a sleeve is provided with hydraulic jaws that wrap around the tube to be driven on its outer surface, transmitting the rotation to it only by means of the friction between jaws and tube. Through hydraulic cylinders that connect the upper rotary table to the base frame it is possible to generate small and limited vertical movements, always less than one meter, and thus exert a thrust or a pull on the tube. The limited vertical movement of the upper frame is not, however, guided by a tower or by elements of the frame, but exploits just the rigidity of the actuators and of the tube itself. In particular, the axial movement is limited because the axial stroke available is always less than the length of the piece of tube that is joined. In some variants, the "rotator" can comprise an autonomous power unit to supply its own actuators. In rare cases the "rotator" is connected to the hydraulic system of the pile driving machine.

The aforementioned external apparatuses for driving such tubes have numerous limitations and drawbacks. Firstly, the cylinders of both types of external apparatuses have limited strokes in the vertical direction, generally of the order of 400-600 millimeters, with consequent limited driving or extraction movements. In particular, the moveable part of these apparatuses, i.e. that capable of transmitting the thrust and the torque, even in the condition of maximum vertical stroke always remains at a height lower than the base of the tower of the machine. This is generally due to the substantial bulk of such apparatuses in the radial direction with respect to the excavation axis. Often, in order to allow the connection of such apparatuses to the machine it is necessary to dismount the lower segment of the tower of the machine. Strokes of greater width could lead to interference or collisions between the mobile part of the external driving apparatuses and the tower of the machine. As a result, in order to drive or extract a few tens of meters of tube a very large number of manoeuvres are needed, each of which comprises the steps of gripping, of translation and of release of the tube, and therefore takes a long time. A second limitation is due to the fact that the aforementioned external apparatuses, gripping the tube laterally through the upper frame, are not able to completely drive the tube until it is flush with the ground surface. In particular, the tube will always extend vertically above the base frame by a minimum amount sufficient to allow it to be gripped laterally. The tube, therefore, always extends at least partially inside such frames of the external apparatuses and, due to the fact that these frames are monolithic and completely surround the tube, the external apparatuses are fixedly connected to the driven tube, not being able to translate horizontally with respect to it. The aforementioned apparatuses, which actively operate only during the driving or extraction steps, are forced to remain on the axis of the pile even during the steps of casting and insertion of the cage that does not involve them. During the inactive steps, the driving apparatuses cannot be moved and exploited on other piles, unless they are lifted through a crane to axially disengage from the driven tube. This solution is, however, complex and not cost-effective.

A further limitation of casing oscillators and of "rotators" is due to the fact that their hydraulic jaws transmit the torque by clamping the tube on its outer surface, only by friction, and this requires the use of very thick tubes or ones with a double wall to prevent it from becoming oval. These tubes are particularly heavy and expensive.

SUMMARY OF THE INVENTION

The purpose of the present invention is therefore to make a device for driving in the ground or extracting from the ground tube segments having a large diameter that is able to solve the aforementioned drawbacks of the prior art in a simple, cost-effective and functional manner. The device according to the present invention, working in support of machines for excavating and making piles, is able to drive or extract tube segments having a large diameter in/from the ground through rotation and pushing or pulling, where the tube segments can have lengths equal to at least once the diameter, preferably from 2 to 5 times the diameter.

In detail, a purpose of the present invention is to make a device for deep driving tubes having a large diameter that makes the driving and extraction steps of the tube faster, at the same time ensuring better verticality.

Another purpose of the present invention is to make a device for deep driving tubes having a large diameter that is able to reduce the idle times, allowing better exploitation and better productivity of the driving apparatus, also thanks to the possibility of the device supporting many pile driving machines within the same worksite.

The embodiments of the device according to the invention favor versatility, making an autonomous means in terms of movement and generation of power and capable of moving by its own means in the area of the worksite. The device has the ability to open a part of its frame at any moment to disengage from the driven tube and move with respect to it, to then be repositioned on it and re-engage at a later time to carry out the extraction. Such a later time is decided by the foreman of the worksite based on economic considerations, and may for example be after the steps of insertion of the reinforcement and of concrete casting. During such steps, which are carried out by independent machinery such as a crane and a concrete pump and that do not require the use of the tubing device, the device itself is able to move autonomously and be positioned on the axis of a second pile to perform the driving of the relative guide tube. At a later time, when the steps of casting and of insertion of the reinforcement of the first pile have ended, the tubing device can go back onto the axis of the first pile to extract the casings. Thanks to this special feature the tubing device can serve more than one LDP machine, being able to go back to and move away from the pile, i.e. being able to disengage from a first tube present on the excavation axis of a first LDP machine to engage on a second pile present on the excavation axis of a second LDP machine. This manoeuvre can be carried out at any stage of excavation desired, and consequently it is possible to drastically reduce the inactive times of the tubing device.

The device according to the invention is advantageous with respect to a generic tubing machine with double "rotary" and continuous helix (CSP), as well as to conventional tubing devices such as casing oscillators or "rotators". The device according to the invention, indeed, being equipped with its own guiding tower, which is distinct from that of the pile driving machine and is much stronger, makes it possible to install on such a guiding tower a rotary table with much better performances in terms of torque and push-pull with respect to the rotary table that would be installable on the tower of the pile driving machine. Such performances are comparable to or better than that provided by casing oscillators or by "rotators" but, unlike such apparatuses, the device according to the invention makes it possible to drive the tube not through short steps with continuous restarts, but rather through a rotation associated with a continuous thrusting movement, able to be perfectly adjusted, the width of which is determined by the stroke of the rotary table on the guiding tower and is proportional to at least once the diameter of the section of tube to be moved. In particular, the stroke available is preferably greater than the length of the section of tube to be moved. In particular, the rotary table installed on the tower of the tubing device can, during its stroke, go to a height greater than the base of the tower of the machine. In greater detail, the rotary table can slide in front of the guides of the tower of the pile driving machine associated with the tubing device. The presence of the guiding tower ensures better verticality of the tubes during the driving step with respect to casing oscillators and to "rotators".

A work method and a series of accessories and constructive solutions facilitate the loading and unloading steps of the tube segments, so as to make the operations safe and fast. The careful study of the work method, associated with the use of such accessories, makes a drilling machine that is versatile and of relatively low weight, and thus cost-effective, suitable for carrying out operations that would require much greater resources if carried out with methods of the prior art.

BRIEF DESCRIPTION OF THE DRAWINGS

The characteristics and advantages of a device for deep driving tubes having a large diameter according to the present invention will become clearer from the following description, given as an example and not for limiting purposes, referring to the attached schematic drawings, in which.

DETAILED DESCRIPTION OF THE INVENTION

Figure 1:
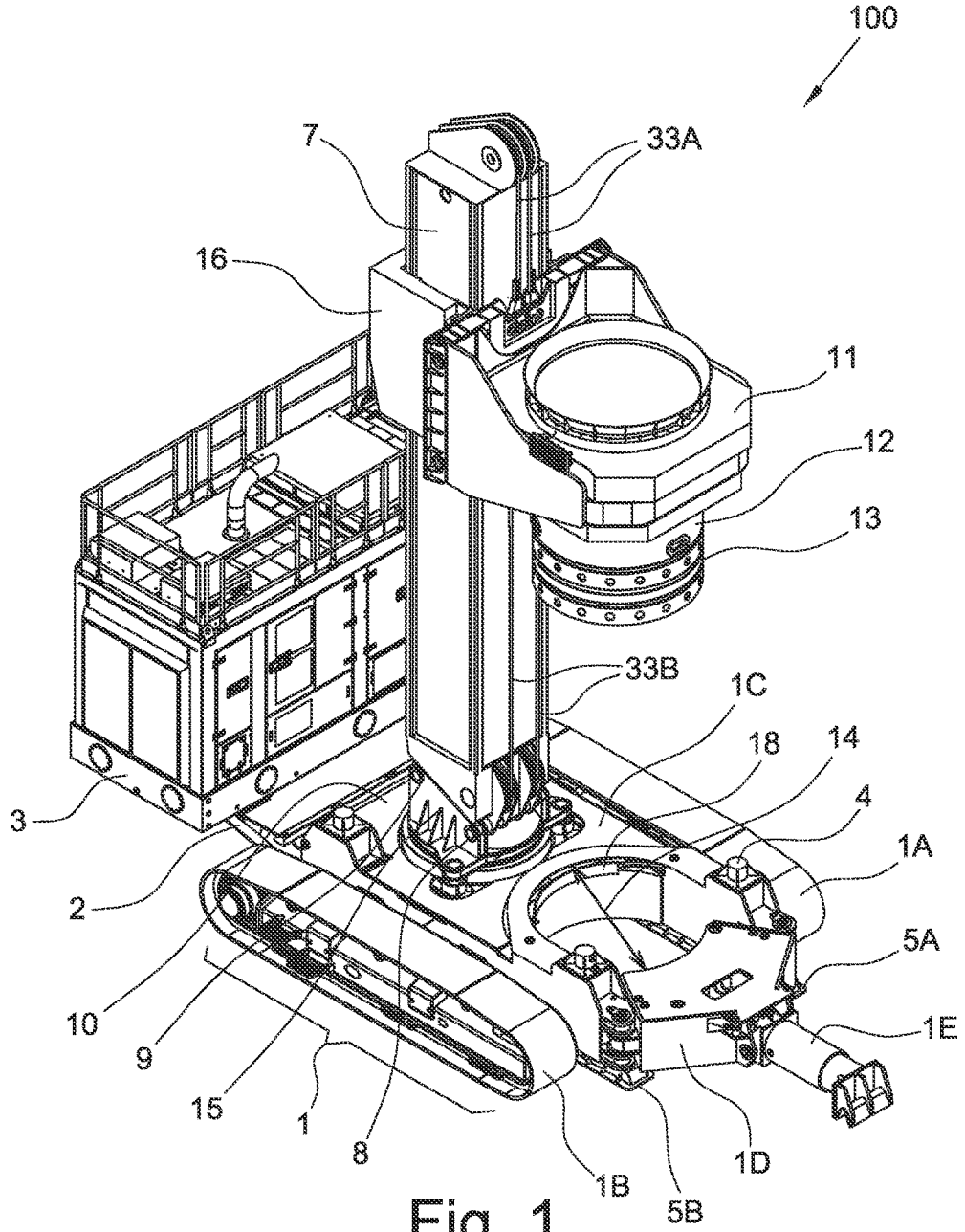
FIG. 1 is a perspective view of an example embodiment of the device for deep driving tubes having a large diameter according to the present invention.

With reference in particular to FIG. 1, an example embodiment of the device for deep driving tubes having a large diameter according to the present invention, or tubing device, is shown wholly indicated with reference numeral 100. The tubing device 100 substantially consists of:

- a base frame or truck 1;
- at least one guiding tower 7, fixedly connected to the base frame 1 through a tower support 15;
- a unit 10 for moving the at least one guiding tower 7;
- a tube operating unit 11, able to slide on each guiding tower 7;
- a bracketed support frame 2; and
- a power group 3.

In particular, with respect to a middle vertical plane of the tubing device 100 and in the operative condition of the tubing device 100 itself, the tube operating unit 11, the guiding tower 7 and the base frame 1 can be assembled in a C-shaped configuration in which, due to stability and proportioning issues of the structures, the guiding tower 7 is in a slightly backward position with respect to the barycenter of the base frame 1.

The tubing device 100 is preferably self-propelled and, for this purpose, the base frame 1 can be provided with tracks 1A and 1B. The base frame 1 is in turn made up of a central load-bearing frame 1C and a moveable or openable front frame 1D, which can comprise a preferably telescopic shaft 1E. The central frame 1C, if observed with respect to a horizontal plane or in a plan view, is characterised, in its front part, by a C-shape or semi-circle shape at the centre of which the driving or drilling axis of the tubing device 100 passes. Such a shape of the central frame 1C determines a space 14 having a diameter sufficient to allow the passage of the tube 300 (see FIG. 3) to be driven in the ground. The front frame 1D, when positioned in operative condition, closes the space 14 in the radial direction. The front frame 1D, in its rear part, is shaped like a circular arc complementary to the shape of the space 14 of the central frame 1C so that, in operative position, the space 14 is circular shaped and can guide the tube 300 to be driven, keeping it vertical and centred on the driving axis. The base frame 1 is adapted to allow the dismounting of the tracks 1A and 1B, so as to reduce the lateral bulk (in width) of the tubing device 100 during transportation, preferably to a value of less than 3.5 meters.

A bracket support frame 2 is removably connected to the rear part of the central frame 1C to support the power group 3. Such a power group 3 is of the known type and provides the flow rate and pressure of oil necessary to supply all of the hydraulic actuations of the tubing device 100. The power group 3 includes, in a per se known way, a plurality of hydraulic pumps, a motor, preferably but not necessarily an internal combustion engine, to actuate such hydraulic pumps, tanks for the oil and possibly for the fuel and all of the necessary accessory systems. Alternatively, the power group 3 could also be provided with electric motors, cables and electric actuators.

The base frame 1 is equipped with stabilizers 4, preferably two on each flank of the central frame 1C, which move two platforms 5A and 5B and allow the entire tubing device 100 to be kept stable on the ground. Preferably, the platforms 5A and 5B are connected with ball joints to the stabilizers 4 and each stabilizer 4 can be actuated independently. In this way it is possible to adapt to the inclinations of the ground and ensure the verticality of the guiding tower 7, in order to obtain a vertical excavation. In particular, through the stabilizers 4 it is possible to vertically move the platforms 5A and 5B until they are brought into contact with the ground and lift the entire tubing device 100, so as to unburden the tracks 1A and 1B from the loads that are generated during the work step, i.e. during the driving into the ground or extraction from the ground of the tube 300. Advantageously, the tracks 1A and 1B are left over the ground. Each platform 5A and 5B has a length comparable to that of the central frame 1C and has a width such as to be able to be placed between each track 1A or 1B and the space 14 of the central frame 1C without interfering with the tracks 1A and 1B or with the tube 300. Thanks to their great length, the platforms 5A and 5B offer a wide contact surface and ensure low contact pressure also in the most difficult conditions, avoiding yielding of the ground that would compromise the stability of the entire tubing device 100.

The guiding tower 7, with a substantially elongated shape, generally has a larger section and a shorter length with respect to the tower of a common pile driving machine, assuming a squat configuration. The guiding tower 7 is mounted on a tower support 15 and is arranged along a vertical axis in the operative conditions of the tubing device 100. The guiding tower 7 is hinged to the tower support 15 on a first axis 8, arranged horizontally, and can be locked in vertical position, for example through pins arranged on a second hinging axis 9 that engage on the guiding tower 7 itself and on the tower support 15. The guiding tower 7 is equipped with guides on which a carriage 16 can slide that supports the tube operating unit 11. The guides are arranged parallel to the longitudinal axis of the guiding tower 7 and can be located on the front part of the guiding tower 7 itself or, preferably, both on the front part and on the rear part, so as to offer better guiding and a larger contact surface. The carriage 16 is moved through an actuation system, which will be described more clearly hereafter, and can transmit to the tube operating unit 11 forces directed both upwards and downwards. These forces can thus be exploited to push the tube 300 in the ground or to extract it from the ground.

The tube operating unit 11 substantially consists of a rotary table equipped with a through sleeve 12 by means of which there is application of a rotation and thus a torque about an axis parallel to the guiding tower 7, as well as of the pulling and thrusting forces in a direction parallel to the guiding tower 7. The sleeve 12 has an internal diameter substantially equal to that of the tube 300 to be driven, so as to allow the passage of an excavation tool that, after having crossed the tube operating unit 11, can remove the ground enclosed in the tube 300 once it is driven. The sleeve 12 has, in its lower part, a system 13 for the automatic hooking and unhooking, of the known type, capable of coupling with or disengaging from the tube 300 without requiring the manual intervention of an operator. The hooking and unhooking system 13 allows the transmission of axial forces and torque between the sleeve 12 and the tube 300, for example through pin or peg-type connections. The tube operating unit 11 is equipped with actuators capable of applying to the sleeve 12 a torque sufficient to set all of the segments of the tube 300 in rotation, overcoming the friction that develops between such tube 300 and the ground during driving. Preferably these actuators consist of hydraulic geared motors fitted onto a toothed crown fixedly connected to the sleeve 12, which rotates on a fifth wheel or on a bearing. In particular, such actuators are suitably arranged around the toothed crown so as to obtain the minimum bulk of the rotary table in the frontal direction, i.e. in the opposite direction to the guiding tower 7 with respect to the excavation axis. In this way, it is possible to apply to the sleeve 12, and thus to the tube 300 connected to the sleeve, continuous complete rotations or partial alternate rotations about the longitudinal axis of the tube itself in both rotation senses. The sleeve 12 and the hooking system 13 are thus engaging means capable both of selectively holding the tube 300, and of transmitting to said tube 300 a rotary motion and an axial sliding movement.

Figure 2:
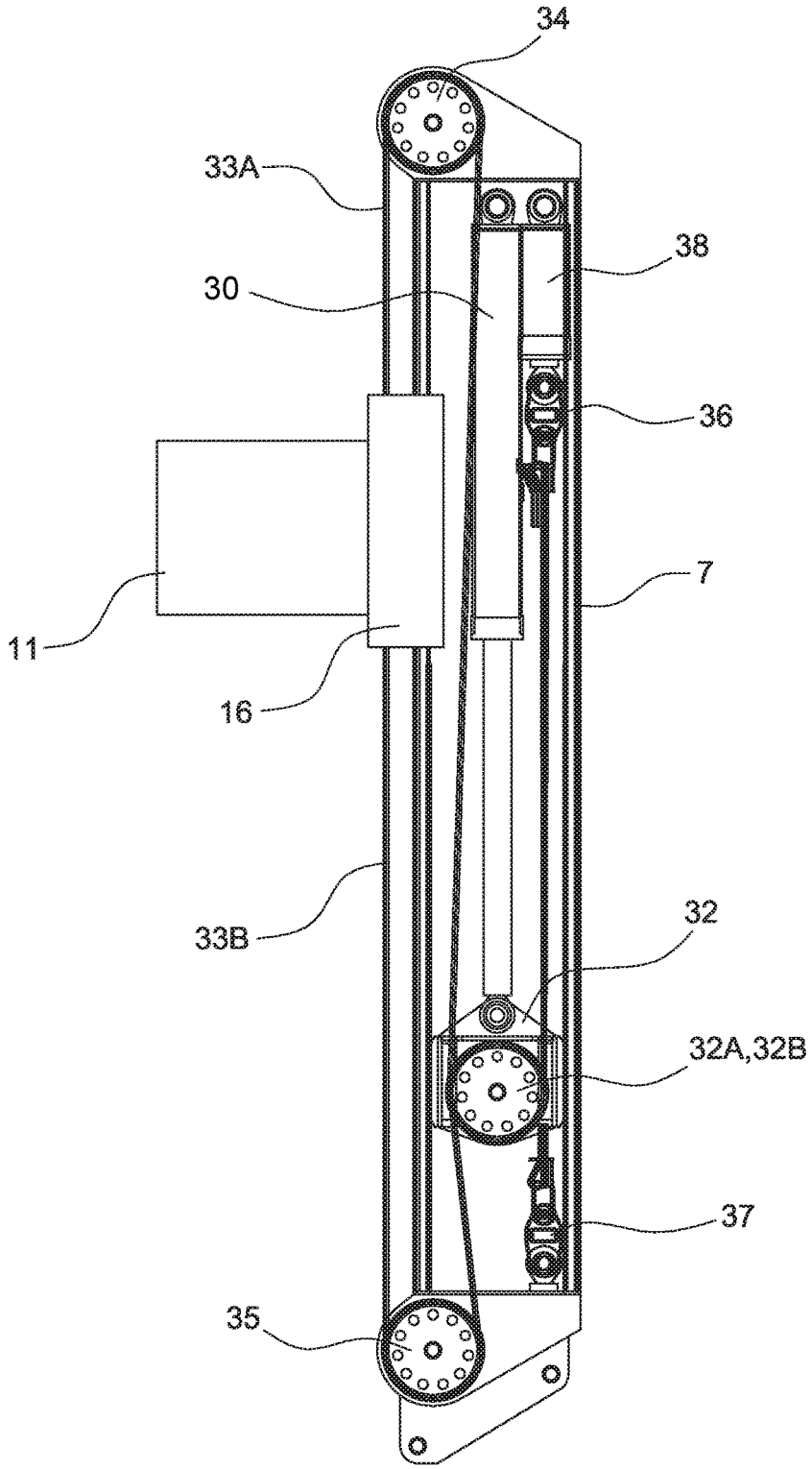
FIG. 2 is a transparent view of the tower of the device of FIG. 1, illustrating a preferred embodiment of the relative actuation system for driving the translation of the rotary table.

FIG. 2 shows a preferred embodiment of the actuating system of the sliding of the tube operating unit 11 on the guiding tower 7. Such sliding is left to a mixed pulling and pushing system that exploits the combination of linear actuators and flexible means and is housed inside the guiding tower 7. One or more linear actuators 30 are preferably placed inside the guiding tower 7 and move a single block 32 equipped with wheels 32A and 32B (only one wheel is visible in FIG. 2) on which the flexible means 33A and 33B wind. The flexible means 33A that drive the ascent are connected with one of their ends to the carriage 16 and, after being transmitted by the upper wheels 34 and by the wheels 32A of the block 32, connect with the other end to a first cable end 36. The flexible means 33B that drive the descent are connected with one of their ends to the carriage 16 and, after being transmitted by the lower wheels 35 and by the wheels 32B of the block 32, connected with the other end to a second cable end 37. The two cable ends 36 and 37 can be fixed directly to the body of the guiding tower 7, or with the interposition of a tensioner 38. This arrangement of the actuating system transfers to the carriage 16 a double stroke and a halved force with respect to those generated by the linear actuators 30, 31. In the preferred embodiment, the linear actuators 30, 31 consist of hydraulic cylinders, the wheels 32A, 32B, 34 and 35 consist of pulleys and the flexible means are cables. In another embodiment the wheels 32A, 32B, 34 and 35 can consist of toothed wheels and the flexible means 33A and 33B can consist of chains.

The system for moving the tube operating unit 11, with the combined use of flexible means and linear actuators, is advantageous since it allows big displacements in proportion to its longitudinal bulk, greater power and speed with respect to those delivered by a winch and, simultaneously, a smaller transverse bulk that facilitates its insertion inside the guiding tower 7. As an example, plausible performance values provided by the push-pull system can be sliding of the carriage 16 of the order of 5-6 meters, total extraction pull of 200 tons and a thrust of 110 tons. The moving system described up to now allows the tube 300 to be driven in the ground carrying out a single continuous stroke of the tube operating unit 11, since such a stroke has a length comparable to or greater than the length of the tube 300 to be driven. The tubing device 100, equipped with such a moving system, is advantageous with respect to known tube driving means, such as casing oscillators and "rotators", which on the other hand require driving of the tube with repeated strokes of limited width.

Figure 3:
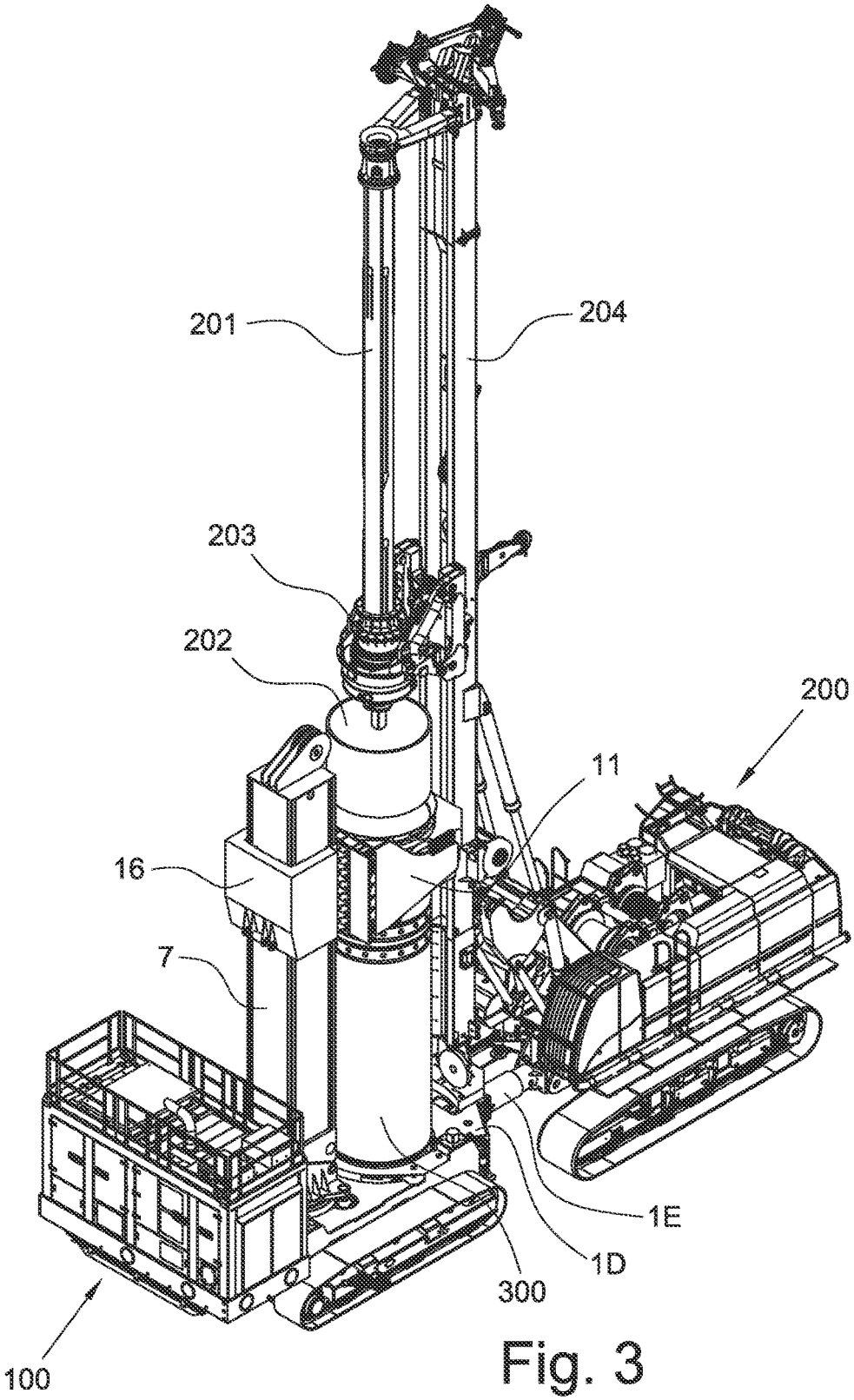
FIG. 3 is a perspective view of the device of FIG. 1, coupled with a known machine equipped with telescopic rods and with a tool for the excavation of piles, in the initial driving step of the tube.

FIG. 3 shows the tubing device 100 that works in support to a known machine 200 to make piles (LDP). The machine 200 could also consist of a crane with scooper or any other apparatus suitable for excavating and/or demolishing and removing the ground confined by the tube 300. The excavation and/or pile driving machine 200, equipped with telescopic rods 201 and with an excavation tool 202 actuated by a rotary table 203, is located in work position with the excavation tool 202 completely lifted and arranged on the excavation axis of the pile. The tubing device 100 is located in the operative condition of start of driving the tube 300, with the tube operating unit 11 completely lifted and arranged on the excavation axis of the pile. In particular, the tube operating unit 11 is positioned in front of the guides of the tower 204 of the excavation machine and temporarily at a greater height with respect to the base of such a tower 204. The tube 300 is connected above the sleeve 12 and can be inserted into the space 14 of the base frame 1 that acts as a lower guide for the tube. The tubing device 100 can go into this position preferably by manoeuvring with its own tracks 1A and 1B, or it can be positioned through external moving means. During these positioning manoeuvres, the tube 300 may also not be loaded on the tubing device 100. Such loading can take place subsequently according to a procedure that will be described more clearly hereafter.

The tubing device 100 can mechanically connect to the excavation and/or pile driving machine 200 through a shaft 1E that in its front part is suitably shaped to hook onto attachments that are normally present on the pile driving machines. Suitable attachments to the undercarriage of the machine 200 can be foreseen as provision for the connection of this external apparatus. This provision serves to discharge onto the undercarriage of the machine 200 part of the forces generated by the torque delivered by the tube operating unit 11 of the tubing device 100. This allows particularly high torques to be applied to the tube 300, since such torques no longer have to be discharged to the ground by the platforms 5A and 5B, and in this way the risk according to which the tubing device 100 could rotate with respect to the excavation axis is eliminated. This configuration is particularly advantageous because the tube 300, if set in opposite rotation to that of the rotary table 203 that moves the excavation tool 202, can partially compensate these stresses without discharging them all to the ground. In particular, the mechanical connection between the base of the tower 204 and the front frame 1D of the tubing device 100 is of the friction type or, more advantageously, of the mechanical abutment type so that the excavation torques can be transmitted between the two parts in mechanical abutment.

Preferably, the shaft 1E has a telescopic structure moved by a linear actuator installed inside the shaft 1E itself, so as to be able to connect to different pile driving machines or to adapt to different work radii of one same excavation and/or pile driving machine 200. The shaft 1E is constrained to the openable front frame 1D through a hinge having horizontal axis, which allows the shaft 1E itself to be inclined by lifting its front part with respect to the ground. Such inclination can be adjusted by an actuator and allows quick hooking or unhooking of the shaft 1E from the attachments of the undercarriage of the machine 200. Preferably, the telescopic elements of the shaft 1E have a circular section and can rotate with respect to one another on the longitudinal axis of the shaft 1E itself. This rotation, combined with the adjustment of the inclination of the shaft 1E, makes it possible to compensate possible differences in inclination between the tracked carriage of the excavation and/or pile driving machine 200 and the base frame 1 of the tubing device 100. Indeed, in the excavation machine 200 the carriage has the same inclination as the ground on which it rests, whereas in the tubing device 100 the base frame 1 is always kept horizontal by adjusting the stabilizers 4 and the platforms 5A and 5B to ensure the verticality of the guiding tower 7. In the excavation machine 200 the verticality of the tower 204 is obtained by acting on the linkage that connects such a tower 204 to the frame of the machine 200 itself.

Again with reference to FIG. 3, it is possible to see how the tubed pile is made by progressively driving the tube 300 in the ground through the tubing device 100 and removing the ground from inside it through the excavation tool 202 actuated by the pile driving machine 200, or upon completion of the driving of the tube 300 or its partial driving when the ground is particularly hard and compact. While the excavation moves forwards, the tube 300 receives the torque and the thrust of the tube operating unit 11, which is moved and guided in the vertical direction on the guiding tower 7 of the tubing device 100. The dimensions of the tube operating unit 11 are particularly compact with respect to the diameter of the driven tube, in particular in the direction in front of the tower 7, and allow the tube operating unit 11 and the rotary table 203 to slide in front of the guides of the tower 204 of the excavation machine 200 without interfering with it. The distance between the excavation axis and the front guides of the tower 204 limits the maximum diameter of the tube that it is possible to drive, in the case of coupling of the tubing device 100 with a pile driving machine of the LDP type. During the emptying step of the tube 300, the excavation tool 202 and the telescopic rods 201 are inserted inside the tube 300 itself, crossing the aforementioned tube operating unit 11, and receive the torque and the thrust from the rotary table 203 that is moved and guided in the vertical direction on the tower 204 of the pile driving machine 200. Once the excavation tool 202 has been loaded with ground moving forward in the excavation, it is made to ascend above the tube operating unit 11 through closing of the telescopic rods 201 and then, carrying out a rotation of the tower 204 with respect to the fifth wheel of the tracked carriage of the pile driving machine 200, it is emptied beside the machine itself. The clearance present between the front guides of the tower 204 and the outer structure of the tube operating unit 11 allows the rotation of the tower 204 even when the tube operating unit 11 is in front of such a tower 204. Thereafter, by completely lifting the excavation tool 202 and rotating the tower 204 in the opposite direction, it is possible to quickly reposition the tool 202 on the excavation axis to carry out another partial excavation.

During the thrusting step of the tube 300 in the ground through the tubing device 100, if the excavation machine 200 is equipped with a foot at the base of its tower 204 it is preferable for this foot to be rested on the openable front frame 1D of the tubing device 100. The openable front frame 1D is suitably shaped and sized to allow such a manoeuvre. Through this operation it is possible to make part of the weight of the machine 200 bear down on the base frame 1 of the tubing device 100. In particular, thanks to the mechanical connection of the shaft 1E and the resting of the foot of the tower 204 on the openable front frame 1D, the two machines 100 and 200 behave like a single rigid body during the thrusting of the tube 300. In this way it is possible to apply very large thrusts to the tube 300, in particular greater than the weight of the tubing device 100 itself, since the weight of the machine 200 also helps with the stability of the assembly. In particular, the tubing device 100 is prevented from lifting. Preferably, during driving, the tube 300 is always kept moving forward, i.e. to at greater depths, with respect to the tool 202 so that the tool 202 itself works always guided by the tube 300. The associated work between the tubing device 100 and the machine 200 makes it possible to carry out simultaneous operations that would require much taller, heavier and more expensive machinery.

Once the insertion in the ground of a segment of the tube 300 has been completed, through the system 13 for the automatic hooking and unhooking the sleeve 12 is disconnected from the segment and another segment of the tube segment 300 is loaded. Such a step will be better described hereafter with reference to FIG. 4. The loading of sections under the tube operating unit 11 of the tubing device 100 is preferably left to the excavation and/or pile driving machine 200, exploiting the service cable with which it is normally equipped. Such a service cable is actuated by a dedicated winch of the machine 200 and, after having been transmitted over the head of the tower 204, is arranged parallel to the telescopic rods 201 and to the same work radius. Therefore, through a simple rotation of the tower 204, such a cable is arranged on the excavation axis. This solution is advantageous because it does not require the presence of a service crane to support the machines 100 and 200, to the great advantage of the cost-effectiveness of the worksite. Another solution for lifting the tube 300 is to connect it to the excavation tool 202, for example through cables or chains, and exploit the vertical movement of the battery of rods 201. In a further embodiment, the tubing device 100 can be equipped with an articulated crane dedicated to loading and positioning the sections of tube 300. Such a crane can be installed for example onto the central frame 1C and can be supplied with power by the same power group 3 of the tubing device 100, thus making it autonomous also in this task.

Figure 4:
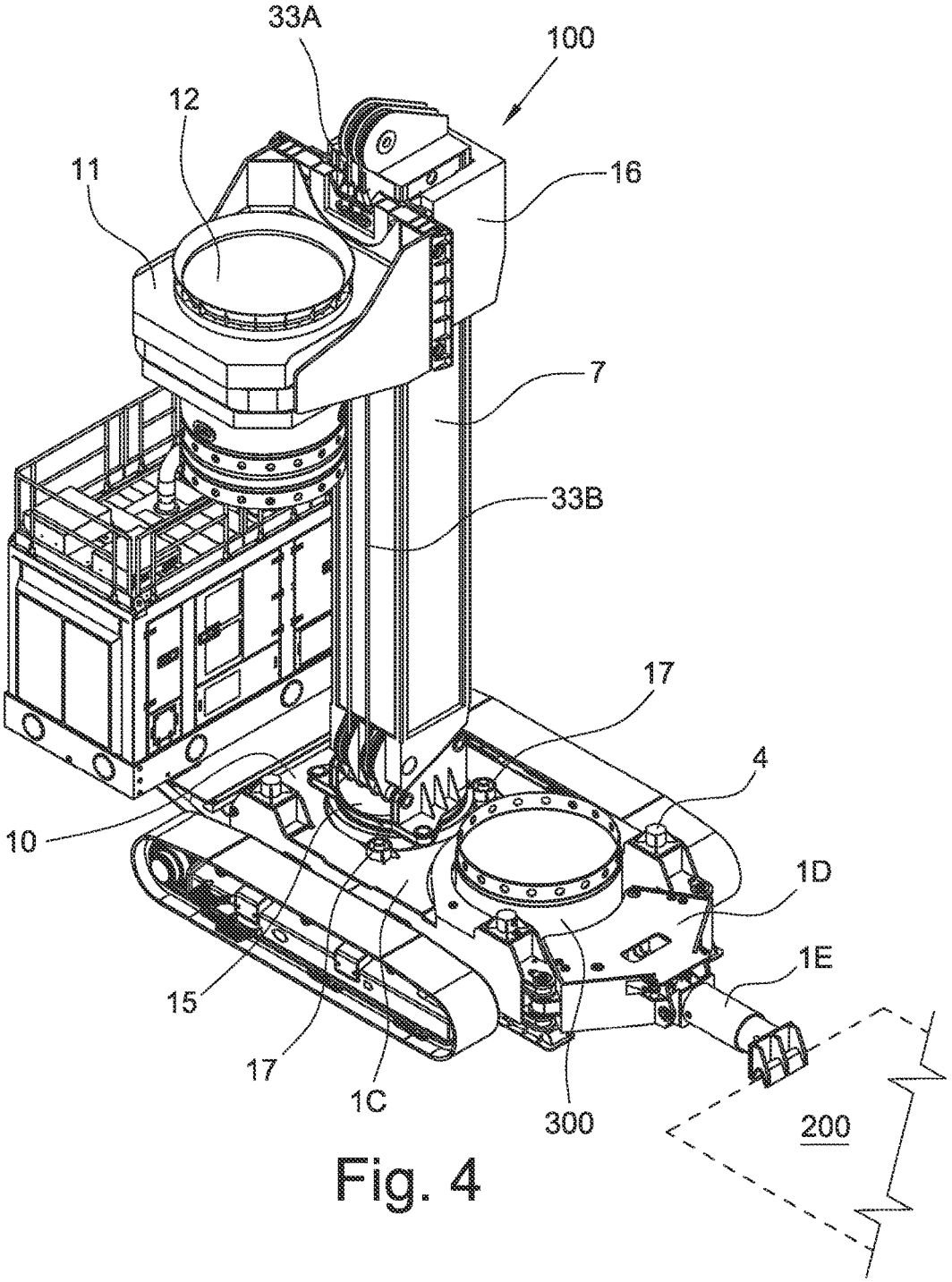
FIG. 4 is a perspective view of the device of FIG. 1 in the operative step in which the tower is rotated to allow the addition of a new tube segment to be driven into the ground.

FIG. 4 illustrates the tubing device 100 with the guiding tower 7 arranged in a configuration such as to allow the loading of another section of tube 300 to be driven. The tubing device 100 is hooked (like in FIG. 3) to the undercarriage of the excavation and/or pile driving machine 200 through its adjustable telescopic shaft 1E and rests on the ground through the platforms 5A and 5B, which make the tubing device 100 itself perfectly horizontal and coaxial to the pile to be made. Since the section of the tube 300 to be added can be positioned on the excavation axis keeping it suspended with a cable, it is necessary for the space above the excavation axis to be completely free and allow access both of the tube 300, and of the cable. For this purpose, the tubing device 100 foresees the possibility of moving the tube operating unit 11 into offset position with respect to the excavation axis, so as to completely free the passage over the space 14 of the base frame 1 and over the tube 300 already driven in the ground. Preferably, such displacement takes place through a rotation of the guiding tower 7 about its longitudinal axis, which is parallel to the excavation axis.

In the preferred embodiment shown in FIG. 4, the tower support 15 is fixed to the central frame 1C in a rotatable manner about a vertical axis parallel to the excavation axis and is locked in the direction longitudinal to the aforementioned axis so as to be able to transmit to the base frame 1 both the thrust, and the vertical pull. The tower support 15 can extend inside the central frame 1C to obtain a more rigid connection and rotates on a bearing or on a fifth wheel. The rotation of the tower support 15 is driven by the unit 10 for moving the guiding tower 7, which includes actuators supplied by the power group 3. These actuators can preferably be geared motors, linear actuators or cable systems. The angle of rotation of the tower support 15 generally has a width of at least 90°, but preferably a complete rotation of 360° is possible, always keeping the possibility of stopping such a rotation also at angles of less than 90°. During the excavation and driving steps of the tube 300, the rotation of the tower support 15 is locked through one or more devices 17 for blocking the rotation. Such devices 17 for blocking the rotation are pins or pegs preferably arranged on the central frame 1C, moved by linear actuators, which can engage in suitable spaces present on the tower support 15 so as to couple it with the aforementioned central frame 1C. When the devices 17 for blocking the rotation are engaged, they can support and transmit to the central frame 1C the torque that is applied to the guiding tower 7. In this way the actuators of the unit 10 for moving the guiding tower 7 are prevented from being strained, which can thus be sized only to carry out such a rotation manoeuvre.

During the loading step of another segment of the tube 300, the devices 17 for blocking the rotation are disengaged so as to temporarily decouple the rotation of the tower support 15 and the guiding tower 7 with respect to the base frame 1, after which the tube operating unit 11 is translated up to the maximum allowed height. Thereafter, the tower support 15, the guiding tower 7 and the tube operating unit 11 are moved in rotation until the space above the space 14 of the central frame 1C is completely freed, taking the bulk of the tube operating unit 11 and of the sleeve 12 completely outside of the passage required for the tube 300. In a less preferred embodiment, it is possible to set the guiding tower 7 and the tube operating unit 11 in rotation, after having temporarily decoupled the guiding tower 7 with respect to the base frame 1, with respect to a horizontal axis present in the tower support 15, instead of with respect to a vertical axis as described earlier, so as to incline the guiding tower 7 itself laterally or at the rear with respect to the excavation axis until the bulk of the tube operating unit 11 and of the sleeve 12 is completely outside of the passage required for the tube 300. The same result can be obtained with a further embodiment in which the guiding tower 7 is operatively connected to the base frame 1 directly, without the interposition of a tower support 15 and in which the guiding tower 7 is inclined laterally or at the rear setting it in rotation with respect to a horizontal axis present in the base frame 1. These solutions are less preferable since they could create unbalancing of the weights and, consequently, a reduction in stability of the tubing device 100. In a further embodiment, the tube operating unit 11 could temporarily be released from the carriage 16 and rotate about a vertical axis or translate, being guided by a guide present on the carriage 16 and moving on a horizontal plane until its bulk is brought completely outside the passage required for the tube 300. In such a solution it is not necessary for the guiding tower 7 and the tower support 15 to be rotatable.

Once the space above the diameter of the excavation has been freed, the excavation and/or pile driving machine 200, through its lifting members, positions a new segment of the tube 300 on the excavation axis, resting it on the segment already driven. At this point the lower end of the new segment is joined to the upper end of the segment already driven through known connection elements, such as screws or pins. Such a connection makes the two segments of the tube 300 integral, allows the transmission of torques and forces between them. The connection is simple to make by worksite workers, since the joining area is located slightly above the central frame 1C of the tubing device 100 and thus at a height and in a position that are easily accessible. The loading step can proceed by carrying out a reverse rotation of the guiding tower 7 and of the tower support 15 so as to take the tube operating unit 11 and its sleeve 12 onto the excavation axis. In particular, the sleeve 12 will be higher up with respect to the upper end of the loaded segment of the tube 300. It proceeds by lowering the tube operating unit 11 along the guiding tower 7 until the system 13 for the automatic hooking and unhooking present in the lower part of the sleeve 12 is made to coincide, in height and in angle with the respective connection points arranged in the upper part of the tube 300. The presence of the system 13 for the automatic hooking and unhooking is advantageous since it makes it possible to carry out the connection between sleeve 12 and tube 300 without requiring worksite workers to climb up (for example five or six meters above ground) to manually make the connection. This speeds up the connection operations and makes them safer. The definition of such a system 13 for the automatic hooking and unhooking is not, however, encompassed in the scope of protection of the invention and the system 13 itself is not strictly necessary, since the connection can still be carried out in a conventional manner according to the procedures of the prior art.

Once the new segment of the tube 300 is fixedly constrained with the tube segments already driven and with the rotation and thrusting members of the tubing device 100, under the combined effect of these two forces the new segment itself is driven into the ground for a large part of its length, preferably for its entire length, and in any case for the entire stroke available to the rotary table tube operating unit 11 along the guiding tower 7, which is comparable to or greater than the length of the tube segment and that in any case is much greater than the stroke of the cylinders of any known "rotator" or casing oscillator. This special feature represents a strong point of the tubing device 100 according to the present invention. During driving, the tube 300 is guided both on top by the sleeve 12, in turn guided by the guiding tower 7, and at the bottom by the space 14 of the central frame 1C. The fact that these guide elements are very far apart (with respect to the guide elements present in a "rotator" or in a casing oscillator) further improves the verticality of the tube segment and therefore of the excavation. By repeating the aforementioned sequence for how many times are necessary, it is possible to tube the pile by adding new segments to the tube 300 until the design height is reached, and/or in any case up to a height dependent on the diameter of the tube and on the consistency of the ground. At the same time, the excavation and/or pile driving machine 200 can excavate the core of ground autonomously from the tube 300 moving forward. The excavation machine 200 will stop its excavation work only to carry out the lifting and the positioning of another section of tube 300 on the column of those already driven. It can be presumed, due to the versatility of the tubing device 100 according to the present invention, that it is possible to drive sections of tube 300 with diameters varying between 1000 and 3000 millimeters and with lengths that can be from 1 to 5 times the diameter. Such lengths, therefore, preferably vary between 1.5 meters and 6 meters.

Once the tubed excavation has stopped, the reinforcement cage is inserted and the pile is cast, for example through casting tubes according to the methodology known in the field. Once the casting is complete, it is necessary to carry out the extraction and unloading, i.e. the separation from the battery, of the tube 300. Such an operation can be carried out by the tubing device 100 by reversing the sequence of operations described for the loading of the tube 300. In particular, by exploiting the extraction pull of the tube operating unit 11, it is possible to lift the entire battery of segments of the tube 300 so as to completely extract the upper segment of tube that must be unloaded. At this point, through the gripping devices 18 of the tube mounted on the base frame 1 and that face onto the space 14 (visible in FIG. 1), it is possible to grip the tube segment immediately below the one to be unloaded, so as to prevent the vertical translation of the battery of tubes inside the excavation. In this way, the upper tube segment can be disconnected from the sleeve 12 and from the tube segment below and, after having rotated the guiding tower 7 to free the passage, it is possible to lift the tube segment and unload it from the tubing device 100. After having reconnected the sleeve 12 to the battery of tubes still in the excavation, the gripping devices 18 are deactivated and a new extraction is carried out. The operations are repeated until all of the tubes are extracted from the excavation. During the extraction step, the tubing device 100 can operate totally autonomously, even without the presence of the excavation and/or pile driving machine 200 if a support crane is available for unloading the segments of the tube 300.

Figure 5:
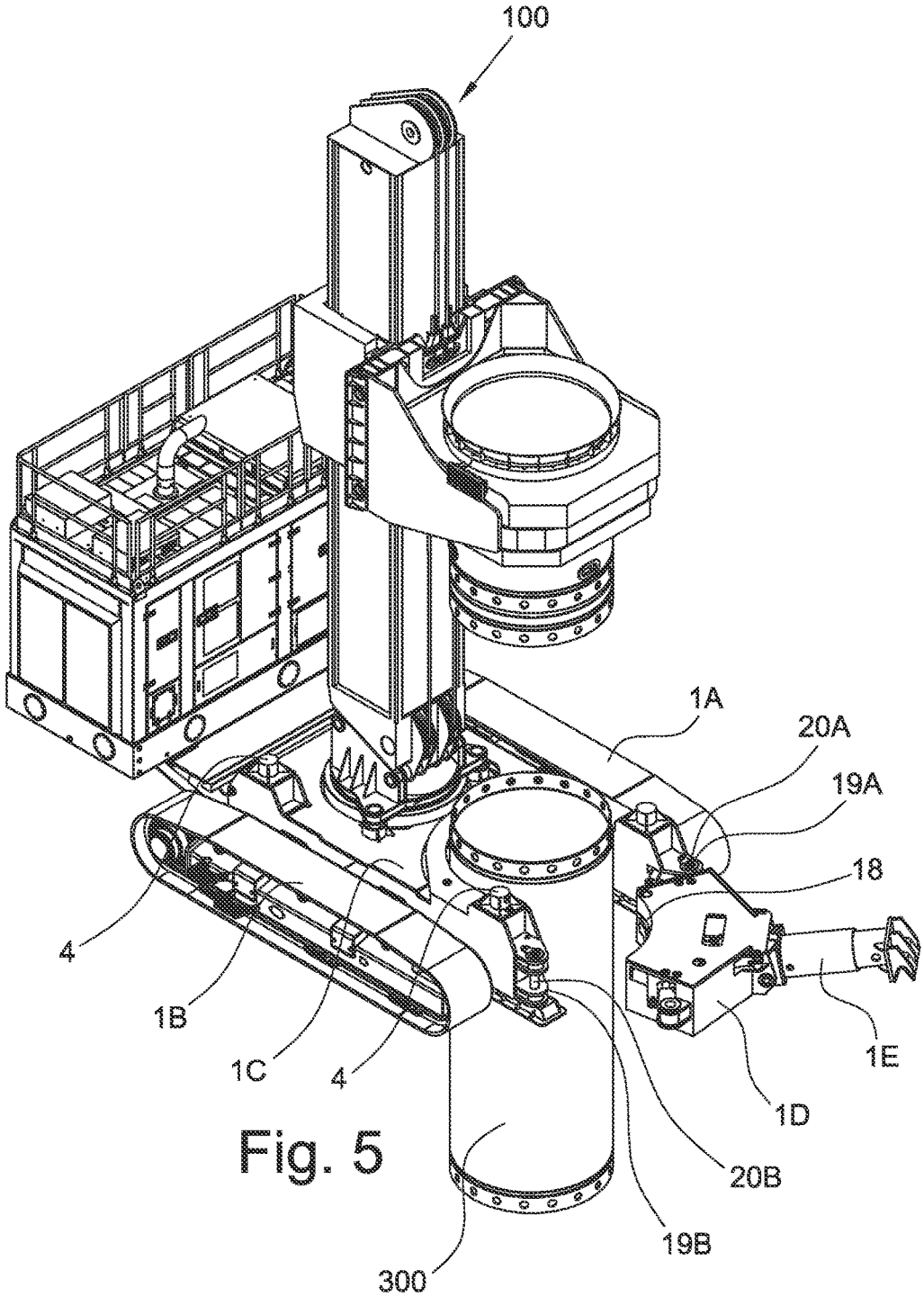
FIG. 5 is a perspective view of the device of FIG. 1 in the operative step in which the frame is opened to allow the device itself to disengage from the tube driven into the ground.

During the casting step, which can take a very long time as a function of the diameter and depth made, the tubing device 100 can disengage from the tube of the pile and move onto the axis of a new pile. Such an advantageous characteristic can be better explained with reference to FIG. 5. FIG. 5 indeed highlights the ability of the tubing device 100 to move part of its base frame 1 to release from the driven tube 300, irrespective of the height of tube that protrudes from the ground surface and crosses the central frame 1C through the space 14.

The front frame 1D, in the preferred embodiment, is coupled with the central frame 1C through two hinges 19A and 19B with vertical axis, in which respective pins 20A and 20B are inserted. Such hinges 19A and 19B are positioned at the front end of the central frame 1C, where it takes up the characteristic C-shape, and arranged on the two opposite lateral flanks. In order that the tubing device 100 can disengage from the tube 300 it is necessary first of all for the sleeve 12 to disconnect from the tube 300 through the hooking and unhooking system 13. The sleeve 12 and the tube operating unit 11 must be lifted by a small amount along the guiding tower 7, so as to be certain not to come back into contact with the tube 300 at the moment when the tubing device 100 rest back on its tracks 1A and 1B. Thereafter, if the tubing device 100 is connected to the excavation and/or pile driving machine 200 arranged in front of it, the telescopic shaft 1E is manoeuvred so as to unhook it from the attachments present on the excavation and/or pile driving machine 200 itself. The platforms 5A and 5B are then lifted through the stabilizers 4, thus allowing the tubing device 100 to rest back on its tracks 1A and 1B. At this point just one of the two vertical pins is extracted, for example the pin 20B, so that the front frame 1D remains hinged to the central frame 1C in a single hinge 19A. Starting from this condition it is possible to move the front frame 1D making it rotate, together with the shaft 1E, about the pin 20A that remained engaged in the corresponding hinge 19A. The arc followed by the aforementioned components is sufficient to create a front opening in the central frame 1C and, in particular, in its space 14 such as to allow the passage, in a direction longitudinal to the base frame and parallel to the ground and to the tracks 1A and 1B, of the tube 300 firmly driven into the ground through the tubing device 100 it moves back, taking its guiding tower 7 away from the excavation axis. Said front opening that is created is clearly visible in figure FIG. 5B. The rotation of the front frame 1D is preferably generated by actuators, such as hydraulic cylinders or geared motors, suitably coupled with the front frame 1D and with the fixed frame 1C so as to generate relative motion. It is thus possible to use the translation itself of the tubing device 100 to generate the movement of the front frame 1D. Another possible solution, not preferred but able to be used in emergencies, is that of disconnecting both pins 20A and 20B so as to completely separate the front frame 1D from the load-bearing frame 1C.

Figure 5B:
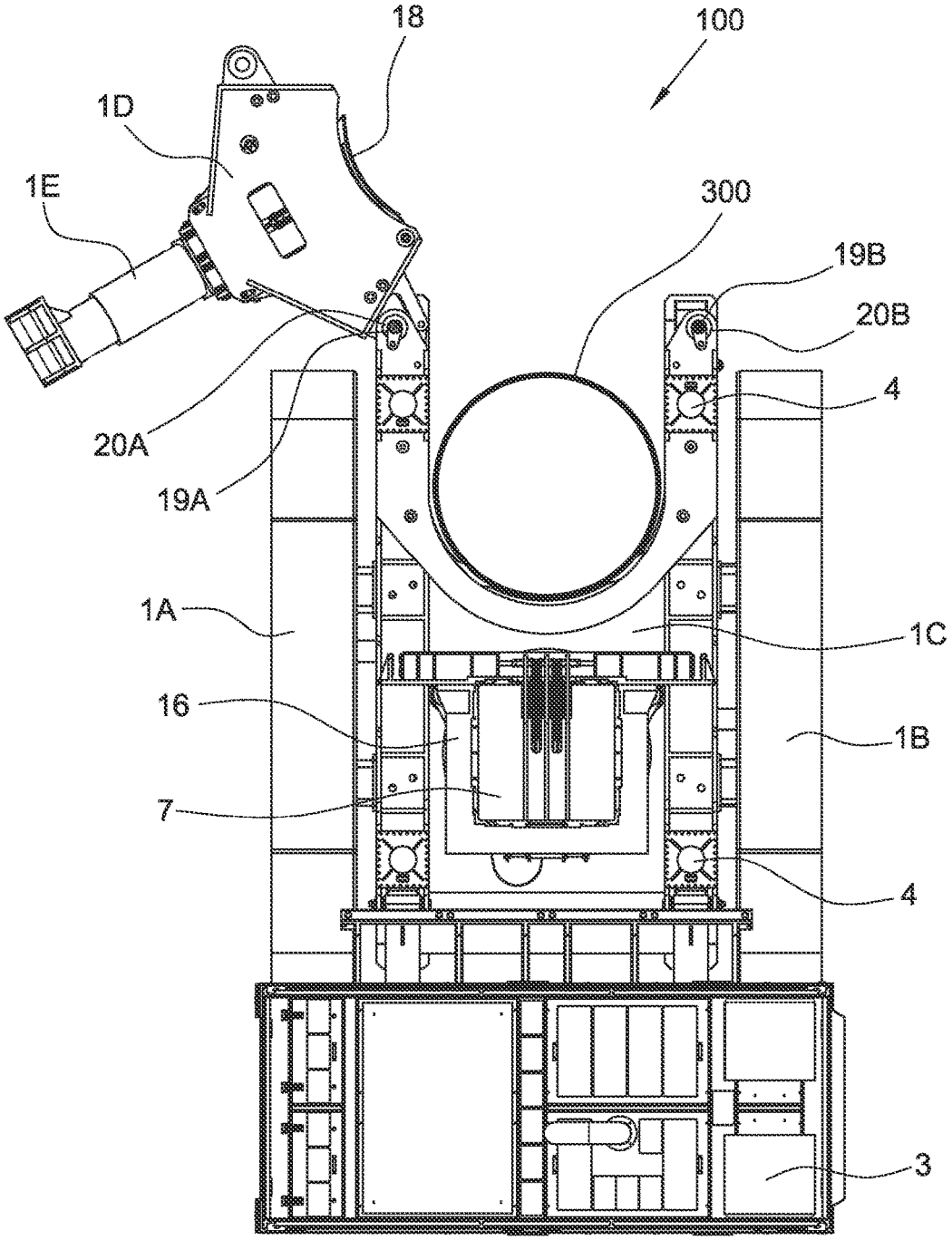
FIG. 5B is a view from above, in which the tube operating unit is not shown, of the device of FIG. 1 in the operative step in which the frame is opened to allow the device itself to disengage from the tube driven into the ground.

FIG. 5B shows a view from above of the tubing device 100 in the operative step in which the front frame 1D is opened to allow the tubing device 100 itself to disengage from the tube 300 driven into the ground even when such a tube 300 extends inside the base frame 1, at least partially crossing it, and in particular inside the space 14. For the sake of greater clarity and in order to allow better visibility of the front opening, FIG. 5B does not show the tube operating unit 11. In greater detail, FIG. 5B clearly shows that the arc followed by the front frame 1D is sufficient to create a front opening in the fixed frame 1C such as to allow the passage, in a longitudinal direction and parallel to the tracks 1A and 1B, of the tube 300.

In another embodiment, the front frame 1D can be hinged to the central frame 1C through hinges having horizontal axis, so that it can be inclined with respect to the ground until it is rotated by 90°, taking the shaft 1E into substantially vertical position. Also in this case a front opening is produced that is sufficient to make the tube 300 come out from the space 14, but with the drawback that the tube must protrude from the ground by a limited height, such as to be able to pass beneath the front frame 1D.

In a further embodiment, the front frame 1D can be coupled with the central frame 1C through vertical guides that allow it to slide vertically up to a height greater than the central frame 1C, so that the offsetting creates a front opening of the space 14 allowing the disengagement of the tube 300. This embodiment also has the drawback that the tube 300 must protrude from the ground by a limited height, such as to be able to pass beneath the front frame 1D.

In the same way as what is described, the tubing device 100 can temporarily open the front frame 1D to couple on a tube driven into the ground and then enclose the front frame 1D to proceed with the extraction step of the tube.

Irrespective of the embodiment, the load-bearing frame 1C, in its C-shaped front part, is sized so as to be able to support the loads generated by the translation of the tubing device 100 even when the front frame 1D is temporarily disconnected from the load-bearing frame 1C.

Another variant foresees that the shaft 1E stays coupled with the excavation machine 200 and the two pins 20A and 20B detach to free the tubing device 100, which can thus move back and release. A second excavation machine, if necessary, could have a second shaft on which the tubing device 100 engages, or furthermore the shaft could be dismounted from the first excavation machine 200 and it could be assembled on the tubing device 100 or on the second excavation machine.

In a further variant embodiment, the tubing device 100 could be equipped with many guide towers 7, preferably two, coupled with the base frame 1. In this variant embodiment the tube operating unit 11 can slide, being guided on many guide towers through one or more carriages 16. The guide towers 7 are in opposite positions with respect to the driving axis of the tube and/or with respect to the middle planes of the tube operating unit 11. In this way, the guide towers 7 and the tube operating unit 11 form portal structures that are advantageous since, thanks to their symmetry, they reduce the flexional loads acting on the guide towers 7 themselves and on the bearing of the sleeve 12.

Figure 6:
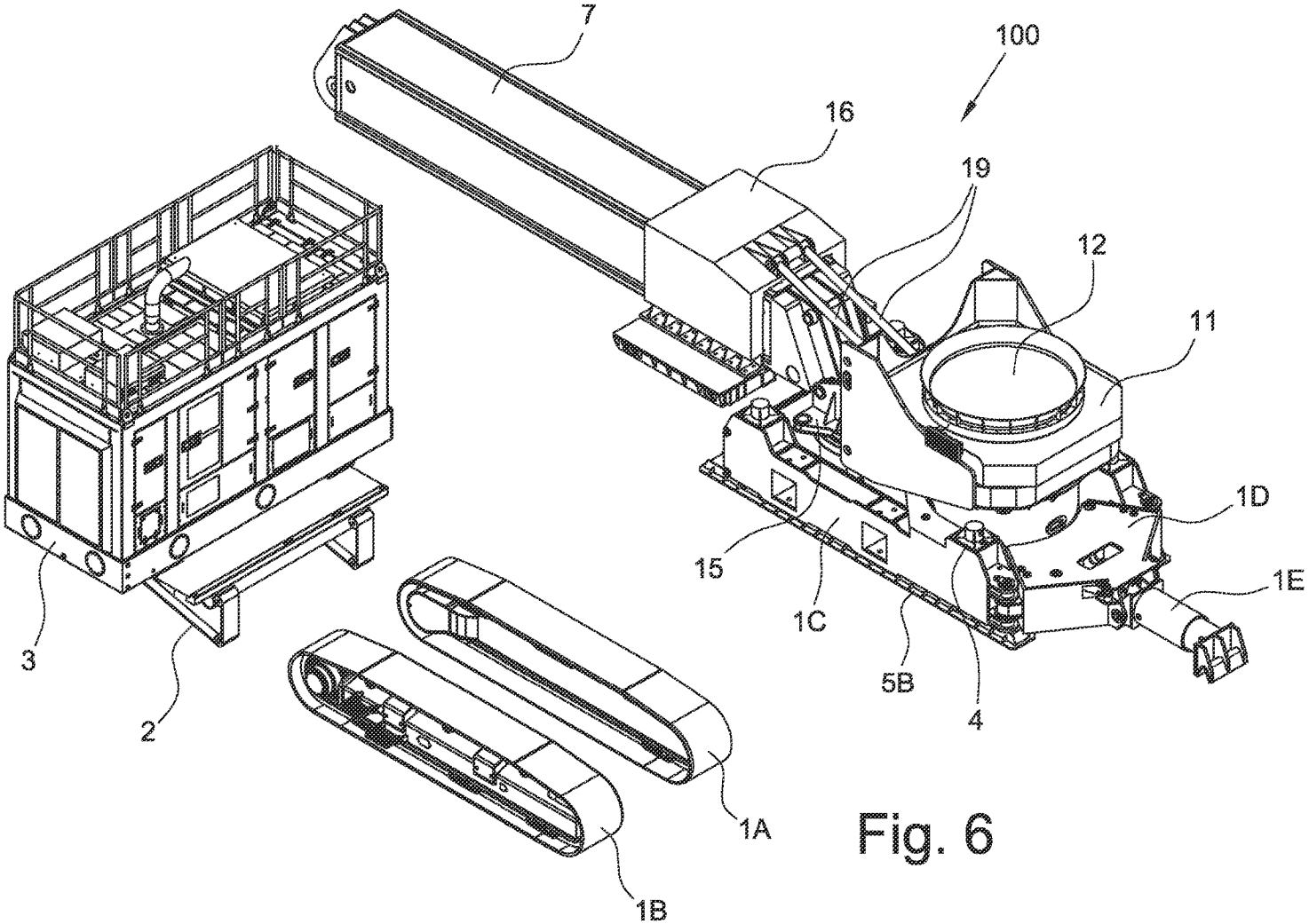
FIG. 6 is an exploded view that shows the groups in which the device of FIG. 1 can be disassembled to facilitate the transportation thereof on road vehicles.

FIG. 6 shows how the tubing device 100 can be partially disassembled to promote its road transportation on a low loader or on a generic trailer for a truck. Since the at least one guiding tower 7 must allow a stroke of the tube operating unit 11 proportional to at least once the diameter of the tube 300, typically at least equal to the length of the tube 300 itself, such a guiding tower 7 has maximum vertical overall dimensions, when arranged in operative conditions of driving or extraction, not compatible with the limitations of road transportation. In order to take the tubing device 100 into a rest configuration or a configuration compatible with transportation it is possible to temporarily release the guiding tower 7 with respect to the base frame 1 and move it so that it is arranged in a condition of minimum vertical overall dimensions. In the preferred embodiment, starting from the operative condition shown in FIG. 1, it is necessary first of all to completely lower the tube operating unit 11, making it slide on the guiding tower 7. During such descent, the sleeve 12 inserts inside the space 14 of the base frame 1 until the body of the tube operating unit 11 rests on suitable abutments present on the central frame 1C. At this point it is possible to disconnect the tube operative unit 11 from the carriage 16 disengaging the connection pins, preferably actuated by remotely driven actuators. It proceeds by lifting the carriage 16 until it is brought above the bulk of the tube operating unit 11. At this point the carriage 16 is connected to the tower support 15 through at least one rigid element 19 that is shaped like a connecting rod. The rigid element 19 has one end hinged to the carriage 16 and the other end hinged to the tower support 15 through pins. The devices 17 for blocking the rotation of the tower support 15 are disengaged and, through the tower moving unit 10, a rotation of 180° of the tower support 15 and of the guiding tower 7 is performed.

The bracketed support frame 2 is then disconnected from the load-bearing frame 1C. The group formed by the support frame 2 and the power group 3 is moved for example laterally to the load-bearing frame 1C, through external lifting means, without interrupting the hydraulic connections between the power group 3 and the actuators of the tubing device 100. Then the pins arranged on the second hinging axis 9 of the guiding tower 7 are disengaged, so as to release the guiding tower 7 from the base frame 1, freeing its rotation with respect to the first hinging axis 8. By lowering the carriage 16 it is possible to load the rigid elements 19 by compression and generate a tilting moment with respect to the first hinging axis 8 of the guiding tower 7, so that such a guiding tower 7 inclines by rotating with respect to the first hinging axis 8. Continuing in the descent manoeuvre of the carriage 16 along the guiding tower 7, the guiding tower 7 itself inclines increasingly until the substantially horizontal transportation configuration is reached. In this final transportation configuration the guiding tower 7 is lowered, i.e. it has a minimum bulk in height lower than the vertical work condition. The push-pull system of the carriage 16 allows such a carriage 16 to be stopped in any intermediate position of the guiding tower 7, avoiding uncontrolled movements of the guiding tower 7 itself during the descent. The weight of the tube operating unit 11 for moving the tube, bearing down directly on the central frame 1C, contributes to maintaining the stability of the tubing device 100 during the lowering of the guiding tower 7. Once this configuration has been reached it is possible to disconnect the tracks 1A and 1B from the load-bearing frame 1C so as to reduce the lateral bulk.

The tubing device 100, in the transportation configuration without the tracks 1A and 1B, without the support frame 2 and without the power group 3, has a weight and dimensions such as to allow transportation on a standard low loader, i.e. of the same type normally used for conventional pile driving machines. This is particularly advantageous because it allows the tubing device 100 to be transported without special permits for road transportation. The group formed by the remaining components 1A, 1B, 2 and 3 is in turn transportable on a second truck respecting the weight and bulk limits set for road transportation. Once the worksite has been reached, exploiting the upward movement of the carriage 16 and the connection through the rigid elements 19, it is possible to again lift the guiding tower 7, taking it back into vertical condition. By repeating the steps described earlier in reverse, the tubing device 100 is brought back into the conditions of FIG. 1. The possibility of exploiting the movement of the carriage 16 to lift or lower the guiding tower 7 is advantageous, since it avoids having to use a support crane and it allows the guiding tower 7 to always be kept connected to the tubing device 100. Moreover, the fact that the carriage 16 can remain mounted on the guiding tower 7 also in the transportation step is advantageous, since it avoids having to disconnect the flexible means 33A and 33B from the carriage 16.

In a further variant embodiment the guide tower(s) 7 could be released from the base frame 1, separating them completely from the latter so that they can be arranged with a yet lower vertical bulk on the means of transport, for example by resting them on the same plane on which the base frame 1 lies. In a further variant embodiment the guide tower(s) 7 could consist of many telescopic sections, so that their length can be reduced by limiting the vertical bulk when they are not in operative configuration.

It has thus been seen that the device for deep driving tubes having a large diameter according to the present invention achieves the purposes outlined earlier, in particular obtaining the following advantages:

the tubing device 100 makes it possible to make tubed piles of great depth and diameter, also secant, starting from a base apparatus totally independent from the excavation machine but associated with it during the operative excavation step, thus operating in close collaboration with it. It is possible to make impermeable diaphragms at great depths with good precision in terms of verticality. The driving can be carried out dry, without addition of stabilizing mixtures. The maximum reachable depth of the guide tube does not depend on a geometric limit, such as the length of the tower or of the battery of telescopic rods, but it is determined as a function of the power of the tubing device 100, of the diameter of the tube and of the consistency of the ground passed through;

the part of the tubing device 100 dedicated to driving the tubes or portions of tubes can be temporarily hooked to the excavation and/or pile driving machine and can be detached at any time, returning the machine to its primary function, without any other provision, said function being that of making an excavation and/or piles of large diameter that are not tubed;

the possibility of hooking the shaft of the tubing device 100 to suitable attachments made in the excavation and/or pile driving machine makes it possible to make the shaft react to the high torque provided by the device itself, discharging part of the forces to the excavation and/or pile driving machine and avoiding undesired rotations of the tubing device 100. This external hooking point makes it possible to provide high torque values with a relatively light tubing device 100;

a support bracket, with a strong structure and obtained in the upper part of the openable front frame, allows the foot of the tower of the excavation and/or pile driving machine to be supported. The tubing device can thus provide high thrust values to the tube, since the weight of the excavation and/or pile driving machine helps with the stability of the tubing device 100, fully exploiting the associability of the two machines;

in the extraction step of the tubes, the tubing device 100 can operate autonomously and it is not obligatory for the excavation machine to be present, provided that a support crane is available that is capable of lifting the single tube segment after it has been extracted from the ground and separated from the battery of tubes. This crane could, in an alternative solution, form part of the same tubing device 100;

the excavation and/or pile driving machine can be of the standard type, not requiring modifications in order to be able to operate in combination with the tubing device 100. The tubing device 100 is not restricted to use combined with a particular model of pile driving machine and, with the due distinctions, it can be associated with many models of pile driving machines and with cranes equipped with excavation means (cylindrical buckets, chisels, etc.), even of different brands;

the ability of the guiding tower 7 to rotate by 360° allows the tubes to be loaded by taking them from both side of the apparatus, facilitating the awkward manoeuvres in worksites;

the preferred use of a system 13 for the automatic hooking and unhooking between the lower part of the sleeve 12 of the tube operating unit 11 and the upper part of the sections of tube ensures that the only fixing operations to be carried out manually can be carried out at the level of the work platform, which coincides with the upper part of the frame of the tubing device 100;

the possibility for the tubing device 100 of moving or opening part of its frame, at any moment of the excavation, and of leaving the tube partially driven, reduces the idle times. With correct time planning, a single tubing device 100 could serve more than one excavation and/or pile driving machine, provided that they are at reasonable distance apart;

with careful designing of the components, it is possible to make a tubing device 100 that, when configured for transportation, is just wider than the tube that it is able to drive. The loads to be moved to reach such a configuration have relatively low weights and are easy to assemble. The heaviest and bulkiest parts of the device, i.e. the guiding tower 7 and the tube operating unit 11, are self-mounting, whereas the remaining parts, such as the support frame 2, the power group 3 and the two tracks, can be mounted with means normally available on a worksite such as forklift trucks;

thanks to the C-shape, in which the tube operating unit 11 is frontally canti-levered, and by virtue of the narrow radial bulks thereof, it is possible to make the tubing device 100 associable with an excavation machine equipped with a vertical tower without creating interference between the tube operating unit 11 of the tubing device 100 and the guiding tower of the excavation machine.

The device for deep driving tubes having a large diameter of the present invention thus conceived can in any case undergo numerous modifications and variants, all of which are covered by the same inventive concept; moreover, all of the details can be replaced by technically equivalent elements. In practice, the materials used, as well as the shapes and sizes, can be whatever according to the technical requirements. The scope of protection of the invention is therefore defined by the attached claims.

The invention claimed is:

1. A self-propelled tubing device of the type operatively connectable to an excavation machine, said excavation machine configured to perform an excavation in the ground inside at least one tube segment, the tubing device comprising: a base frame, the tubing device being self-propelled by the base frame independently of the excavation machine, at least one guiding tower for the at least one tube segment, said at least one guiding tower of the tubing device being connected to the base frame by a tower support, and a tube operating unit, operatively connected to the at least one guiding tower of the tubing device, wherein the tube operating unit is slidable along the at least one guiding tower of the tubing device and is provided with engaging means capable of both selectively holding the at least one tube segment and of transmitting a rotary motion and an axial sliding movement to said at least one tube segment, so as to allow the progressive driving in the ground thereof and a subsequent extraction from the ground, wherein said axial sliding movement is guided by the at least one guiding tower of the tubing device and wherein an amount of said axial sliding movement is determined by a stroke of said tube operating unit on said at least one guiding tower of the tubing device and is proportional to a diameter of the at least one tube segment, wherein the tubing device is operatively connectable to more than one excavation machine, being capable of disengaging from a first tube segment present on an excavation axis of a first excavation machine and then engaging in a second tube segment present on an excavation axis of at least one second excavation machine, and wherein the a least one guiding tower of the tubing device and the tube operating unit are placed opposite to a tower of the excavation machine and the tube operating unit can slide opposite to said tower of the excavation machine without interfering therewith.

2. The tubing device according to claim 1, wherein the tube operating unit is configured so as to apply to the at least one tube segment continuous complete rotations and partial alternate rotations about a longitudinal axis of said at least one tube segment in both clockwise and counter-clockwise directions.

3. The tubing device according to claim 1, wherein the at least one guiding tower is arranged along a vertical axis during operation of the tubing device, said at least one guiding tower being at least temporarily releasable from the base frame to handle the tube operating unit and to bring the tube operating unit completely outside a passage required for the at least one tube segment, so as to allow both loading of the at least one tube segment on the tubing device and unloading of the at least one tube segment from said tubing device after the at least one tube segment is extracted from the ground.

4. The tubing device according to claim 1, wherein the at least one guiding tower is arranged along a vertical axis during operation of the tubing device, said tower support being at least temporarily releasable from the base frame.

5. The tubing device according to claim 4, wherein the tower support can be operated in a rotatable manner about a vertical axis parallel to an excavation axis of the excavation machine, in order to rotate according to an angle having a predetermined width.

6. The tubing device according to claim 5, further comprising one or more devices for blocking the rotation, capable of blocking a rotational movement of the tower support during the steps of excavation and driving and extraction of the at least one tube segment, so as to allow transmission of loads, which are impressed to said at least one tube segment by the tube operating unit, to the base frame.

7. The tubing device according to claim 1, wherein the at least one guiding tower is releasable with respect to the base frame, so as to shift from an operative condition of maximum vertical overall dimensions, wherein said at least one guiding tower is blocked in vertical position with respect to the base frame, to a rest or transport configuration of the tubing device, wherein said at least one guiding tower is released from the frame and is arranged in a configuration of minimum vertical overall dimensions.

8. The tubing device according to claim 1, wherein the sliding movement of the tube operating unit along the at least one guiding tower is driven by an actuating system comprising one or more linear actuators placed in the at least one guiding tower, said one or more linear actuators being capable of handling flexible means which control the climb and the descent of a carriage, movable on guides, which supports said tube operating unit.

9. The tubing device according to claim 1, wherein the base frame to which the at least one guiding tower is operatively connected is provided with a shaft operatively connectable to the excavation machine, so as to allow a discharge of at least part of forces generated by the torque applied to said at least one tube segment, from the tube operating unit to the excavation machine.

10. The tubing device according to claim 1, wherein the base frame comprises a central frame, a front part of said central frame being C- or semicircle-shaped, and a front frame having a rear part, said rear part being shaped like a circular arc complementary to a shape of said central frame, so as to define a circular space at the center of which an excavation axis passes and a diameter of which is enough to allow passage of the at least one tube segment to be driven in the ground, so that a top of said at least one tube segment is guided by said engaging means, and a bottom of said at least one tube segment is guided in said circular space by the front part of the central frame and the rear part of the front frame, so that said at least one tube segment is maintained upright and centered on the excavation axis.

11. The tubing device according to claim 10, wherein the front frame is movable with respect to the central frame in order to create a front opening in the circular space defined by the front part of the central frame and the rear part of the front frame, said front opening being configured for allowing the passage of the at least one tube segment firmly driven in the ground in a direction longitudinal to the base frame, while the tubing device moves back, moving the at least one guiding tower away from the excavation axis.

12. The tubing device according to claim 1, wherein the engaging means comprise a through sleeve, by means of which a rotation, a torque and pulling and thrusting forces are applied on the at least one tube segment, said sleeve having an inner diameter substantially equal to a diameter of said at least one tube segment, so as to allow passage of an excavation tool which, after having crossed the tube operating unit, can remove the ground enclosed in the at least one tube segment once said at least one tube segment has been driven.

13. The tubing device according to claim 12, wherein the engaging means further comprise an automatic hooking and unhooking system in a lower part of the sleeve, said automatic hooking and unhooking system being capable of coupling to or disengaging from the at least one tube segment without requiring manual intervention of an operator and allowing transmission of axial and torque forces between said sleeve and said at least one tube segment.

14. The tubing device according to claim 1, wherein with respect to a middle vertical plane of the tubing device and in the operative condition of said tubing device, the tube operating unit, the at least one guiding tower and the base frame are assembled in a C-like configuration wherein, due to stability and proportioning issues of said tubing device, the at least one guiding tower is in a backward position with respect to a barycenter of the base frame.

15. A method for performing an excavation in the ground, enclosed at least partially within at least one tube segment, using a tubing device according to claim 1 operatively connectable to an excavation machine, the method comprising the steps of:

operatively connecting the tubing device to the excavation machine provided with at least one excavation tool so that at least one guiding tower of the tubing device is opposite a guide tower of the excavation machine;

loading the at least one tube segment on the at least one guiding tower of the tubing device by connecting said at least one tube segment to engaging means of a tube operating unit;

progressively driving the at least one tube segment in the ground by activating the tube operating unit in a rotatable and translatable manner, and removing, simultaneously or subsequently, the ground from the inside of said at least one tube segment by an excavation tool actuated by the excavation machine;

once the insertion of the at least one tube segment in the ground has been completed, disconnecting said at least one tube segment from the at least one guiding tower of the tubing device by means of the engaging means of the tube operating unit;

loading in sequence one or more additional tube segments on the at least one guiding tower of the tubing device when a planned depth of excavation is not reached, connecting said one or more additional tube segments above the first tube segment which has been previously driven in the ground, so as to drive said first tube segment further down up to the planned depth, in order to complete the excavation; and once a pile has been made by performing a casting inside the excavation provided with tubing, extracting each tube segment from the excavation site and subsequently unloading each tube segment from the tubing device by inverting the sequence of the loading and driving steps.

* * * * *